United States Patent [19]

Pütz

[11] 4,033,855

[45] July 5, 1977

[54] MINERAL OIL DEWAXING PROCESS WITH DEHYDRATION OF FEED AND SOLVENT

[75] Inventor: Joachim E. Pütz, Offenthal, Germany

[73] Assignee: Edeleanu Gesellschaft mbH, Frankfurt, Germany

[22] Filed: Nov. 24, 1975

[21] Appl. No.: 634,960

[30] Foreign Application Priority Data

Nov. 26, 1974 Germany ..... 2455785

[52] U.S. Cl. ..... 208/25; 208/33

[51] Int. Cl.[2] ..... C10G 43/04; C10G 43/08

[58] Field of Search ..... 208/25, 33, 32.1

[56] References Cited

UNITED STATES PATENTS

| | | | |
|---|---|---|---|
| 2,443,532 | 6/1948 | Berg | 208/33 |
| 2,907,709 | 10/1959 | Benedict | 208/33 |
| 2,911,350 | 11/1959 | Kerns | 208/25 |
| 2,949,419 | 8/1960 | Benedict | 208/33 |
| 3,130,143 | 4/1964 | Salmon et al. | 208/33 |
| 3,448,016 | 6/1969 | Hoppe | 208/33 |

*Primary Examiner*—Herbert Levine

*Attorney, Agent, or Firm*—Thomas H. Whaley; Carl G. Ries; William E. McNulty

[57] ABSTRACT

In a mineral dewaxing process, the oil solvent and the wax-containing mineral oil feed are dehydrated by a combination of flash evaporation, steam stripping and azeotropic distillation.

10 Claims, 1 Drawing Figure

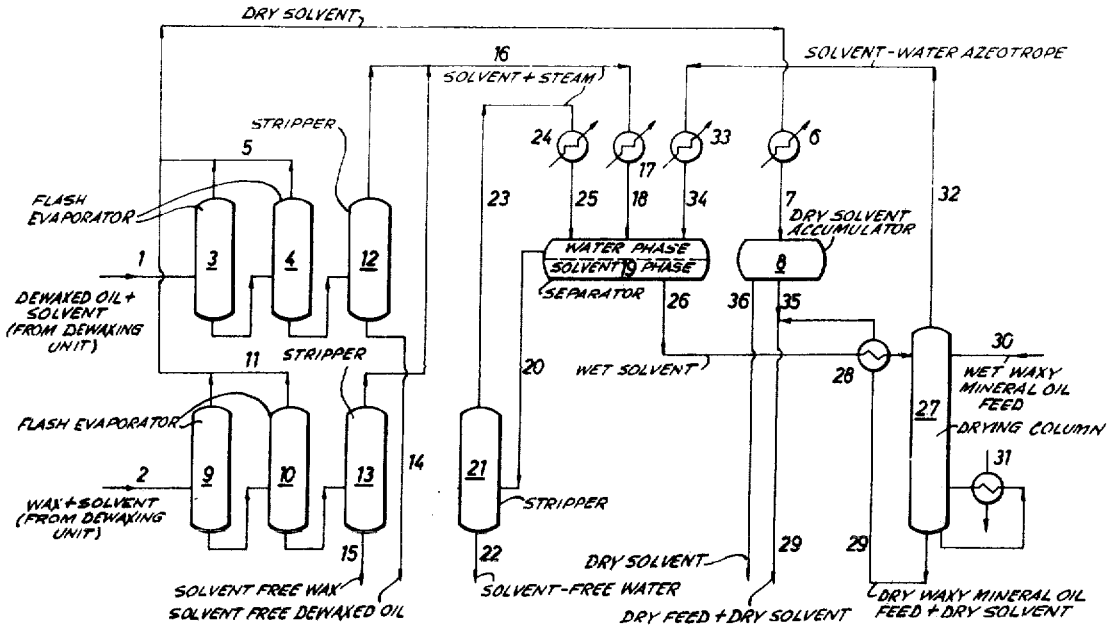

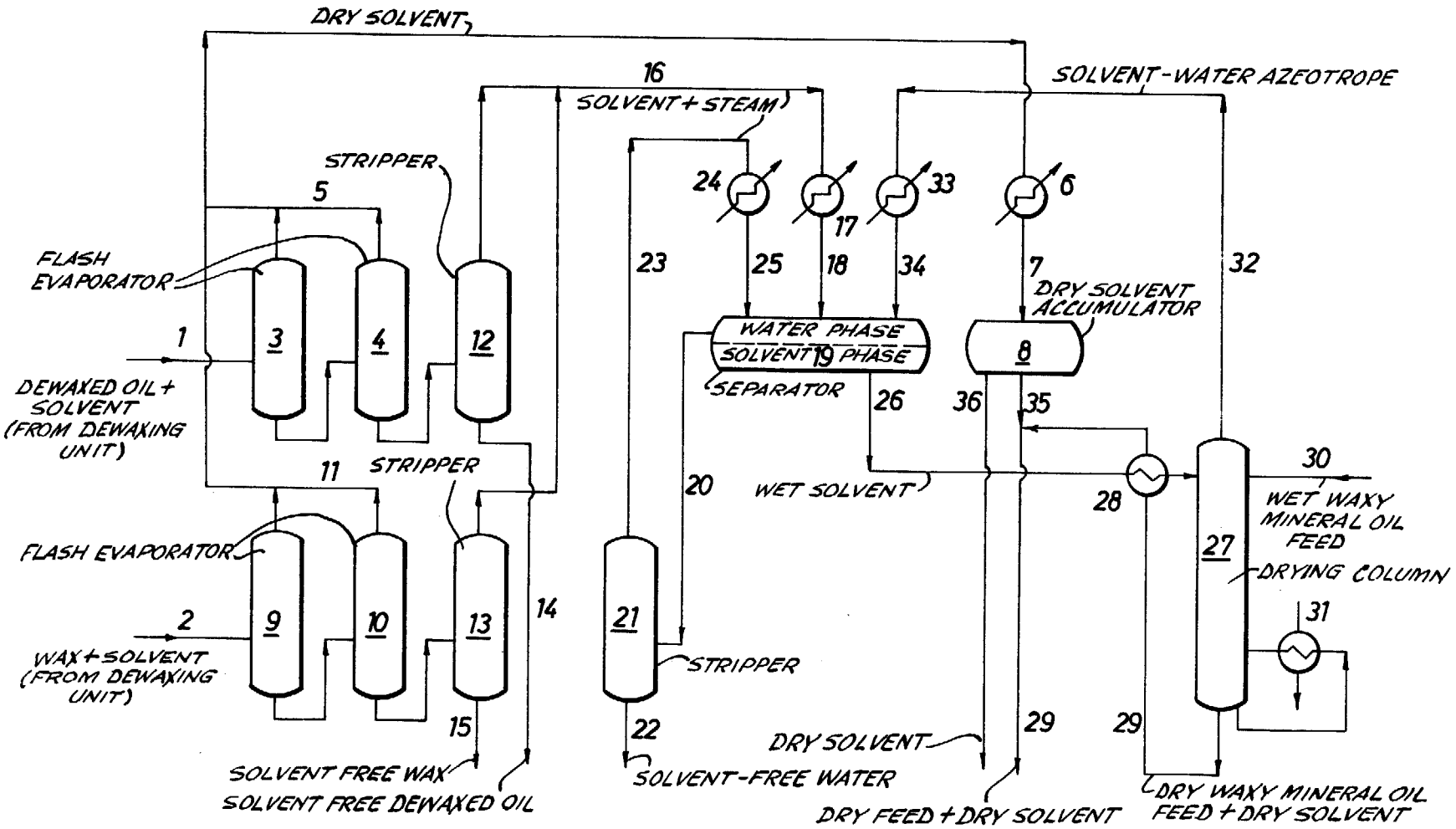
SOLVENT-WATER AZEOTROPE
WET WAXY MINERAL OIL FEED
DRYING COLUMN
DRY WAXY MINERAL OIL FEED + DRY SOLVENT
DRY SOLVENT ACCUMULATOR
DRY SOLVENT
DRY FEED + DRY SOLVENT
WATER PHASE
SOLVENT PHASE
SEPARATOR
WET SOLVENT
DRY SOLVENT
DRY FEED + DRY SOLVENT
STRIPPER
SOLVENT-FREE WATER
SOLVENT + STEAM
SOLVENT-FREE WAX
SOLVENT FREE DEWAXED OIL
STRIPPER
STRIPPER
DRY SOLVENT
FLASH EVAPORATOR
DEWAXED OIL + SOLVENT (FROM DEWAXING UNIT)
FLASH EVAPORATOR
WAX + SOLVENT (FROM DEWAXING UNIT)

MINERAL OIL DEWAXING PROCESS WITH DEHYDRATION OF FEED AND SOLVENT

BACKGROUND OF THE INVENTION

The dewaxing of mineral oils is known and is performed on a commerical scale by processes known as solvent dewaxing and urea dewaxing. In these two major processes, of which a great number of different embodiments has been described, first a solution of the mineral oil to be dewaxed in an organic solvent or a mixture of organic solvents is prepared, as, for example, explained in the book entitled "Mineralole . . ." by C. Zerbe, 2nd edition (1969), part 1, pp. 472 and 482–83. (To eliminate the repeated use of "organic solvent or a mixture of organic solvents", the term "solvent" will be used hereinafter and shall be taken to include a mixture of solvents unless specified to the contrary.)

In the solvent dewaxing process, this solution of mineral oil and solvent is cooled down, whereby paraffins are depositing as crystals. In the urea dewaxing process, the solution is contacted with urea or a urea solution and the n-paraffin/urea insertion compounds or adducts, depositing as crystals, are separated. These adducts are then decomposed to recover an n-paraffin product and urea or urea solution. In both processes a solution of the dewaxed mineral oil in the respective solvent is obtained. Since both processes are operated continuously, it is necessary to separate the solvent from the dewaxed mineral oil and to recover the solvent which is normally done in multistage flash evaporator stations of which at least the last stage is a steam stripper.

The known dewaxing processes are disadvantageous insofar as the recovered solvent may contain great quantities of water coming partly from the feed oil to be dewaxed and partly from the strippers in the evaporator station. Due to the continuous recycling of the recovered solvent this water content is constantly increasing up to an equilibrium value and may involve considerable difficulties:

1. In the cooling stage of the solvent dewaxing process, the operating and cooling performances of the heat exchangers — which are mostly scraped wall exchangers — are greatly impaired by the formation of ice. They frequently need to be turned off, thawed and cleaned, as explained, for instance, in U.S. Pat. Nos. 2,478,456, column 1, and 2,949,419, column 6, line 42.

2. In the filtering stage of this process, ice crystals form when water-containing solvents are used for washing the slack wax cake at the usual operating temperatures of about −20° to −40° C and said ice crystals clog the pipes, equipment, nozzles and filtering cloth (cf., e.g., German Pat. No. 1,545,279, column 1, line 62 to column 2, line 10).

3. Dissolving capacity and selectivity of the solvent may be unfavorably changed with reduces quality and yield of the products (cf., U.S. Pat. No. 3,105,809, column 6, lines 59 to 63).

4. Halogenated hydrocarbons and other solvents hydrolytically or thermally unstable may split off corrosive substances at the elevated temperatures prevailing in the flash evaporator station. These corrosive substances corrode the flash evaporation equipment and make it necessary to use expensive non-corrosive materials (cf. U.S. Pat. No. 3,105,809, column 6, line 60).

5. In urea dewaxing with crystalline urea, water contained in the mineral oil/solvent mixture changes the selectivity of adduct formation as well as the form and consistency of the adducts. If a fine-powdery adduct is to be obtained, a relatively low water content may not be exceeded.

There are known processes which are directed to reducing the water content of the solvent used in solvent dewaxing units. In U.S. Pat. No. 2,478,456 or German Pat. No. 909,386 a method of chemical drying is described in which the drying agent has to be either regenerated at high cost or rejected. The process disclosed in U.S. Pat. No. 2,478,456 only changes the form of the ice developing in the cooling stage of a solvent dewaxing process, so that no solid ice is deposited at the walls of the cooler. This requires, however, the introduction of a substance foreign to the system but does not prevent such undesirable side effects as corrosion and negative effect on the dissolving capacity.

Another commonly used process dries the recovered water-containing solvent condensate by azeotropic distillation, optionally, with prior partial extraction of the solvent by means of the dewaxed mineral oil filtrate or molten wax (cf., U.S. Pat. Nos. 2,949,419 and 3,130,143). However, the different embodiments of this known drying process are rather expensive, since several drying and distillation columns, additional extractors, several separators, and the like are required. Besides, they have the disadvantage that water entrained with the feed oil is constantly introduced into the dewaxing unit and only removed in the drying stage of the solvent recovering unit. Thus, the above-mentioned disturbances continue to exist in the majority of the various previous stages of the dewaxing process.

This disadvantage is also involved in the process disclosed in German Auslegeschrift 1,545,279. The known process is directed to the recovery of chlorinated hydrocarbon solvents from the dewaxed mineral oil filtrate and the separated crude n-paraffin or slack wax obtained in solvent dewaxing. The solvent vapors from the first oil filtrate evaporator are condensed in two steps and the water-free and wax-free solvent portion liquefied in a first condenser is passed to a main solvent collector, while the non-condensed water-containing solvent portion is liquefied in a second condenser and, after water separation, is introduced as part of the recycled solvent, into a rectifying column into whose lower part the water-containing and wax-containing solvent vapors from the first crude paraffin evaporator are introduced. The water-containing overhead product from the rectifying column is introduced into the second condenser, and the solvent vapors from the last oil filtrate flash evaporator and the last crude paraffin flash evaporator are passed, after condensation and separation of water, as a second part of the recycled substanced into the rectifying column, while the water-free n-paraffin-containing bottoms product from the rectifying column is added, via a second solvent collector, to the feed oil to dilute the latter.

It is the main object of the invention to provide a process for dewaxing mineral oils which is free of the above described disadvantages and enables working under essentially water-free conditions in a simple manner.

SUMMARY OF THE INVENTION

To achieve the object of this invention, a combination of flash evaporation, steam stripping and azeotropic distillation is employed to dehydrate the wet oil solvent and the wet, waxy mineral oil feed in the dewaxing process. Specifically, the wax product and the dewaxed oil, each containing quantities of oil solvent, are each separately flash vaporized and steam stripped to produce dry oil solvent and wet oil solvent plus an oil solvent-free wax product and an oil solvent-free dewaxed oil filtrate product. The steam strippers overhead is condensed and separated into an aqueous phase and a wet oil solvent phase. The wet oil solvent phase is recovered, combined with the wet mineral oil feed, and the mixture subjected to azeotropic distillation to produce a dry mineral oil feed.

BRIEF DESCRIPTION OF THE DRAWING

The accompanying drawing is a schematic flow diagram of an embodiment of the process units and flow systems suitable for carrying out the process of the present invention.

DESCRIPTION OF THE PREFERRED EMBODIMENTS

The present invention relates to an improved mineral oil dewaxing process. Specifically, the improvement is in a mineral oil dewaxing process selected from the group consisting of solvent dewaxing and urea dewaxing wherein an oil solvent is admixed with a waxy mineral oil feed and a dewaxed mineral oil filtrate is separated from the wax producing a wax product containing a portion of said oil solvent and a dewaxed mineral oil filtrate containing a second portion of said oil solvent, said oil solvent forming an azeotrope with water, said improvement, for dehydrating wet waxy mineral oil feed and wet oil solvent, comprising:

a. flash vaporizing the wax product containing the first portion of said oil solvent thereby producing a first oil solvent flash vapor and a flashed wax bottoms containing some oil solvent,
b. steam stripping the remaining oil solvent from the flashed wax bottoms thereby producing a first vaporous water-oil solvent mixture and oil solvent-free wax as a product stream,
c. flash vaporizing the dewaxed mineral oil filtrate containing the second portion of said oil solvent thereby producing a second oil solvent flash vapor and a flashed dewaxed mineral oil filtrate bottoms containing some oil solvent,
d. steam stripping the remaining oil solvent from the flashed dewaxed mineral oil filtrate bottoms thereby producing a second vaporous water-oil solvent mixture and a solvent-free mineral oil filtrate as a product stream,
e. condensing the first oil solvent flash vapor of step (a) and the second oil solvent flash vapor of step (c) thereby producing a condensed oil solvent,
f. condensing the first vaporous water-oil solvent mixture of step (b), the secod vaporous water-oil solvent mixture of step (d), and the vaporous oil solvent-water azeotrope, hereinafter described in step (h), thereby producing a condensed mixture of oil solvent and water,
g. separating said condensed mixture of oil solvent and water from step (f) into an aqueous phase of oil solvent and water and an organic phase of wet oil solvent,
h. distilling the wet oil solvent of step (g) and the wet waxy mineral oil feed to produce an oil solvent-water azeotrope as an overhead product and a mixture of a water free-mineral oil feed and water free-oil solvent as a bottoms product, and
i. passing said bottoms product together with condensed oil solvent from step (e) to the mineral oil dewaxing process as the feed stream thereto.

As utilized herein, the terms "wet solvent", "wet mineral oil" and other "wet" liquids refer to mixtures of water and solvents, mineral oil or liquid. The water may be present as a separate phase, i.e. free water, or dissolved in the solvent, mineral oil or liquid, i.e., bound water. The correlative terms "dry solvent", "dry mineral oil" and other "dry" liquids, as used herein, mean a solvent, a mineral oil or liquid containing substantially no water.

The subject of this invention may also be described as a process for dewaxing mineral oils by treatment with solvents, possibly with the addition of urea, separation of a dewaxed mineral oil filtrate and wax as well as recovery of the solvents from the dewaxed mineral oil filtrate and the wax by distillation, advantageously in several steps, characterized by a. removing practically all water from the wet feed oil to be dewaxed and at the same time from the recycling wet solvent by azetropic distillation in a dryer column,
b. dewaxing the dry feed oil in the absence of water in a manner known per se,
c. expelling the major part of the solvent from the mineral oil filtrate and wax thus obtained in at least one first indirectly heated flash vaporizer column each, and recovering said solvent in water-free form,
d. removing the remaining solvent from the mineral oil filtrate and wax in at least one stripping column each by injecting steam,
e. condensing the stripping column vapors consisting of solvent and water,
f. separating the phases of the condensate in a separator,
g. dehydrating the wet organic phase of the condensate together with the feed oil by azeotropic distillation in the dryer column, and
h. passing the dry bottoms product of this column consisting of solvent and feed oil without any further pre-treatment to the dewaxing stage.

In the process of the invention, the major portion of the solvent, still present in the dewaxed mineral oil filtrate and the wax obtained, is removed from each of these streams in at least one indirectly heated flash evaporator column of the multi-stage flash evaporator stations of the recovery plant, and condensed in an essentially water-free and wax-free form and recovered. This recovered dry solvent may amount to about 95 wt.% of the total amount of solvent used. The much smaller portion of the used solvent still remaining after the flash vaporization of the dewaxed mineral oil filtrate and the wax is removed from each of these streams in a steam stripping column. The vapors consisting of solvent and water are condensed and passed to a separator where the aqueous phase is separated. The wet organic phase of the separator is passed to a drying column into which all the waxy mineral oil feed is introduced simultaneously. The overhead product of the drying column is condensed and passed back to the separator. The bottoms product of the drying column is a substantially water-free, warm solution of the mineral oil to be dewaxed dissolved in the solvent and is passed to the dewaxing unit.

Thus, the process of the invention requires only a single drying column for dehydrating the wet solvent and the entire feed oil. Since the bottoms product of the drying column has a temperature far above the melting point of the wax contained in the feed oil, the usual heating of the feed oil up to or beyond the melting point of the wax may be omitted when employing the process of the invention. The dry solution of mineral oil to be dewaxed or the dry feed oil that is obtained as the bottoms product of the drying column, can be mixed with the recovered dry solvent so that all streams introduced into the dewaxing unit are practically free from water. Further, the solvent passing from the indirectly heated first flash evaporator columns of the flash evaporator station remains free from water. This dry solvent constitutes, as mentioned further above, the major part of the recovered solvent. Since this major portion of solvent is recovered from the indirectly heated flash evaporator columns in the absence of water, it neither contains any parts of mineral oil filtrate nor wax which might otherwise be entrained in the presence of water. Since the solvent vapors are free of wax, the solvent vapors obtained from the mineral oil filtrate and the wax may be condensed jointly and introduced, without additional treatment, into the dewaxing unit as washing or diluting agents.

In the stripping columns of the vaporizer station, where the final residues of solvent are removed from the dewaxed mineral oil and the wax, small portions of mineral oil and wax may pass over to the solvent, due to the reduced vapor pressure resulting from the introduced steam. The possibility that the dry solvent from the drying column may contain oil or wax (since the wet solvent fed to this drying column may be so contaminated) is no disadvantage since the dry solvent is admixed with the dry waxy mineral oil feed to form the bottoms product from the drying column.

Furthermore, only a minor enlargement of a dryer column, designed solely for dehydration of the wet solvent, is necessary, in order to additionally dry therein the entire feed oil to be dewaxed according to the process of the invention. If the feed oil to be dewaxed contains, for example, water in the usual concentration of about 0.02 weight percent, additionally drying the total feed oil necessitates an increase in the vapor space volume of the dryer column of only 18%, corresponding to an increase in the diameter of the dryer column of about 8–10%.

A variety of oil solvents is used in solvent dewaxing and urea dewaxing. The solvents commonly employed in solvent, dewaxing include ketones, for example, acetone, methyl ethyl ketone, methyl isopropyl ketone, methyl isobutyl ketone, and their mixtures. The ketone solvent is often modified by the addition of an aromatic hydrocarbon, for example, benzene or toluene. Among the oil solvents employed in urea dewaxing are low boiling solvents, used along or as part of a mixture, including low molecular weight aliphatic branched chain alcohols, cyclic alcohols, ethers, ketones, hydrocarbons and chlorinated hydrocarbons, as well as some aromatics and naphthenes. Specific examples of the urea dewaxing solvents include isohexanol, cyclohexanol, diethyl ether, butanone, methyl isobutyl ketone, butane, pentane, isopentane, hexane, isohexane, dichloromethane, dichloroethane, benzene, methylcyclopentane and mixtures thereof. Any of these above named solvents which form an axeotrope with water may be used in the process of this invention.

In urea dewaxing, the urea may be used in solid form, as a powder or a solution to form the adduct with n-paraffins.

The process of the invention is further illustrated by means of the flowplan for the solvent recovery unit of a solvent or urea dewaxing process, and the following example wherein the solvent is assumed to have a higher specific gravity than water.

EXAMPLE 1

From a dewaxing unit (not shown in the flow plan) two product streams 1 and 2 were removed. Stream 1 consisted of the dewaxed mineral oil, stream 2 of the separated wax. Both streams contained an organic solvent that needed to be recovered. Stream 1 was introduced into the indirectly heated flash evaporator columns 3 and 4, from whose top the major part of the solvent was drawn off, passed via pipe 5 to condenser 6 where it is condensed in practically water-free form and passed to dry solvent accumulator 8 via pipe 7. Stream 2 was passed to the indirectly heated flash evaporator columns 9 and 10. Their overhead product, water-free solvent vapor, was introduced into pipe 5 via pipe 11 and passed to condenser 6 and into dry solvent accumulator 8.

The flashed bottoms product of columns 4 and 10 was passed to steam stripping columns 12 and 13, respectively, and there freed from the final solvent residues by direct introduction of steam. As bottoms product of stripping column 12, a solvent-free dewaxed mineral oil was obtained and drawn off via pipe 14. Solvent free wax was the bottoms product of stripping column 13 and was drawn off via pipe 15. The overhead from each of stripping columns 12 and 13 consisted of solvent and steam vapors which flowed together in pipe 16 to condenser 17 where it was condensed. The condensate reached separator 19 via pipe 18 where it separated into two phases, an upper aqueous phase containing a small amount of solvent, and a lower organic phase in which some water was dissolved.

The aqueous phase of separator 19 was fed to column 21 via pipe 20 where it was freed from the solvent by injection of steam so that solvent-free waste water left the plant via pipe 22. At the top of column 21 wet solvent vapor passed to condenser 24 via pipe 23. The condensate reached separator 19 via pipe 25.

The wet solvent phase from separator 19 was passed, via pipe 26, to heat exchanger 28 and finally to drying column 27. In heat exchanger 28 the wet solvent was preheated by the bottoms product from drying column 27 supplied via pipe 29. As a second stream, the entire feed oil, i.e. the mineral oil to be dewaxed, reached drying column 27 via pipe 30. At the top of the drying column 27, vaporous azeotrope comprising the solvent and all of the water contained in the streams supplied by pipes 26 and 30, was drawn off to condenser 33 via pipe 32 and the condensate introduced into separator 19 via pipe 34. The heat required for azeotropic distillation was supplied to dryng column 27 by means of a by-pass system running through sump boiler 31. As bottoms product from drying column 27, a water-free warm solution of the mineral oil to be dewaxed in the solvent was drained off via pipe 29.

The mixture carried in pipe 29 was diluted (after cooling in heat exchanger 28) with water-free solvent coming from dry solvent accumulator 8 via pipe 35, in a ratio as required for the following dewaxing process. From dry solvent accumulator 8 further dry solvent was removed via pipe 36 and directly passed on to a treatment zone (e.g. filtering, repulping and/or decomposition stage of a urea dewaxing plant).

The above example clearly shows the advantages of the process of the invention: Up to about 95 wt.% of the solvent passes through the dewaxing plant in water-free form. The mineral oil feed is dehydrated prior to dewaxing, i.e. jointly with the small portion of solvent recovered in wet condition. Thus, continuous introduction of water with the feed is prevented and the operational disturbances of dewaxing units, described further above, are avoided. The process of the invention is especially advantageous for urea dewaxing units in which fine-powdery adducts are produced, since only water-free working conditions guarantee the production of this type of adduct.

I claim:

1. In a mineral oil dewaxing process wherein an oil solvent is admixed with a waxy mineral oil feed, and a dewaxed mineral oil filtrate is separated from the wax producing a wax product containing a portion of said oil solvent and a dewaxed mineral oil filtrate containing a second portion of said oil solvent, said oil solvent forming an azeotrope with water, the improvement for dehydrating wet waxy mineral oil feed and wet oil solvent which comprises:

a flash vaporizing the wax product containing the first portion of said oil solvent thereby producing a first oil solvent flash vapor and a flashed wax bottoms containing some oil solvent, b. steam stripping the remaining oil solvent from the flashed bottoms thereby producing a first vaporous water-oil solvent mixture and oil solvent-free wax as a product stream, c. flash vaporizing the dewaxing mineral oil filtrate containing the second portion of said oil solvent thereby producing a second oil solvent flash vapor and a flashed dewaxed mineral oil filtrate bottoms containing some oil solvent, d. steam stripping the remaining oil solvent from the flashed dewaxed mineral oil filtrate bottoms thereby producing a second vaporous water-oil solvent mixture and a solvent-free mineral oil filtrate as a product stream, e. condensing the first oil solvent flash vapor of step (a) and the second oil solvent flash vapor of step (c) thereby producing a condensed oil solvent, f. condensing the first vaporous water-oil solvent mixture of step (b), the second vaporous water-oil solvent mixture of step (d), and the vaporous oil solvent-water azeotrope, hereinafter described in step (h), thereby producing a condensed mixture of oil solvent and water, g. separating said condensed mixture of oil solvent and water from step (f) into an aqueous phase of oil solvent and water an an organic phase of wet oil solvent, h. distilling the wet oil solvent of step (g) and the wet waxy mineral oil feed to produce an oil solvent-water azeotrope as an overhead product and a mixture of a water free-mineral oil feed and water free-oil solvent as a bottoms product, and i. passing said bottoms product together with condensed oil solvent from step (e) to the mineral oil dewaxing process as the feed stream thereto.

2. A process according to claim 1, including the following additional steps:

j. steam stripping the aqueous phase from step (g) thereby producing a third vaporous water-oil solvent mixture and an oil solvent-free water stream k. condensing said third vaporous water-oil solvent mixture together with said first and second vaporous water-oil solvent mixtures and said vaporous oil solvent-water azeotrope in step (f).

3. A process according to claim 1 wherein the dewaxing process is solvent dewaxing and the oil solvent comprises a ketone.

4. A process according to claim 3 wherein the oil solvent comprises methyl ethyl ketone.

5. A process according to claim 3 wherein the oil solvent comprises methyl isobutyl ketone.

6. A process according to claim 1 wherein the dewaxing process is urea dewaxing, the urea used to form the adduct is selected from the group consisting of solid urea, urea in powder form and urea solution and the oil solvent is selected from the group consisting of low molecular weight aliphatic branched chain alcohols, cyclic alcohols, ethers, ketones, hydrocarbons, chlorinated hydrocarbons, aromatics, naphthenes and mixtures thereof.

7. A process according to claim 6 wherein the oil solvent is selected from the group consisting of isohexanol, cyclohexanol, diethyl ether, butanone and methyl isobutyl ketone.

8. A process according to claim 6 wherein the oil solvent is selected from the group consisting of hexane and isohexane.

9. A process according to claim 6 wherein the oil solvent is selected from the group consisting of dichloromethane and dichloroethane.

10. A process according to claim 6 wherein the oil solvent is selected from the group consisting of benzene and methylcyclopentane.

* * * * *